US007946833B2

(12) United States Patent
Mordukhovich

(10) Patent No.: US 7,946,833 B2
(45) Date of Patent: May 24, 2011

(54) VARIABLE DISPLACEMENT VANE PUMP

(75) Inventor: Gregory Mordukhovich, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 611 days.

(21) Appl. No.: 11/951,010

(22) Filed: Dec. 5, 2007

(65) Prior Publication Data

US 2009/0148324 A1 Jun. 11, 2009

(51) Int. Cl.
*F03C 4/00* (2006.01)
*F04C 2/00* (2006.01)

(52) U.S. Cl. ..... 418/17; 418/27; 418/223; 418/268

(58) Field of Classification Search ..... 418/17, 418/24–28, 223, 259, 266–268
See application file for complete search history.

(56) References Cited

U.S. PATENT DOCUMENTS 2,636,480 A * 4/1953 Becker ..... 418/223
3,008,423 A * 11/1961 Miller ..... 418/17
3,200,756 A * 8/1965 Ratliff, Jr. ..... 418/27
3,744,939 A * 7/1973 Grennan et al. ..... 418/30
4,551,080 A * 11/1985 Geiger ..... 418/28

FOREIGN PATENT DOCUMENTS

| | | | | |
|---|---|---|---|---|
| CN | 1162701 A | | 10/1997 | |
| CN | 1435571 A | | 8/2003 | |
| CN | 100516523 C | | 2/2009 | |
| DE | 102007036608 A1 | | 8/2003 | |
| GB | 2094890 A | * | 9/1982 | 418/268 |
| JP | 55043211 A | * | 3/1980 | 418/268 |

* cited by examiner

*Primary Examiner* — Theresa Trieu

(57) ABSTRACT

The present invention provides a vane pump having variable displacement and high efficiency. The variable displacement vane pump includes a plurality of elongate, axially extending inserts disposed in the rotor. One of the inserts is disposed between every adjacent vane pair. The inserts are received within axially extending pockets in the rotor and are coupled to the rotor by springs. At lower rotational speeds, the inserts are retracted and the displacement of the pump chambers is at maximum. At higher rotational speeds, the inserts are advanced into the pump chambers, effectively reducing their displacement. Thus, the variable displacement pump compensates for the varying drive speed and achieves improved uniformity of fluid flow by providing maximum displacement at low speeds and reduced displacement at higher speeds.

20 Claims, 2 Drawing Sheets

VARIABLE DISPLACEMENT VANE PUMP

FIELD

The present disclosure relates to a variable vane pump and more particularly to a variable vane pump having speed dependent displacement.

BACKGROUND

The statements in this section merely provide background information related to the present disclosure and may or may not constitute prior art.

The majority of passenger car and light and medium duty trucks utilize automatic transmissions having hydraulic fluid control circuits. A hydraulic pump within the transmission provides a flow of pressurized hydraulic fluid which is controlled by valves to actuate various clutches and brakes to select and achieve the desired gear (speed) ratio.

The size of a hydraulic pump, often characterized by the available or generated hydraulic fluid flow rate and pressure, in an automatic transmission can be problematic. On the one hand, it must be large enough to deliver sufficient flow and pressure at low speeds to enable proper operation of the valves, clutches and brakes. A configuration that achieves this will, however, invariably deliver excess flow and pressure at high speeds, flow which is returned through a pressure regulator valve to a sump. Such excess pump capacity at high speeds is obviously inefficient but is an undesirable but essentially inevitable result of sizing the pump for sufficient fluid delivery at low speeds.

One solution to this problem has been the use of two pumps: a first lower volume pump and a second, higher volume pump. This solution is less efficient than a single pump, still requires a pressure regulator valve and also requires control devices which switch between the two pumps in accordance with a predetermined operating schedule.

Variable displacement vane pumps are known in the art. However, such pumps suffer from inefficiencies which conventional, fixed displacement pumps do not exhibit. Thus, a vane pump having a variable displacement capability which exhibits the efficiency of a conventional, fixed displacement vane pump would be desirable. The present invention is so directed.

SUMMARY

The present invention provides a vane pump having variable displacement and high efficiency. The variable displacement vane pump includes a plurality of elongate, axially extending inserts disposed in the rotor. One of the inserts is disposed between every adjacent vane pair. The inserts are received within axially extending pockets in the rotor and are coupled to the rotor by tension or compression springs. At lower rotational speeds, the inserts are retracted and the displacement of the pump chambers is at maximum. At higher rotational speeds, the inserts are advanced into the pump chambers, effectively reducing their displacement. Thus, the variable displacement pump compensates for the varying drive speed and achieves improved uniformity of fluid flow by providing maximum displacement at low speeds and reduced displacement at higher speeds.

The variable displacement vane pump according to the present invention finds broad application and is suitable for use in automatic transmissions, internal combustion engines, hydraulic control systems and all other hydraulic pump installations in which the drive speed to the pump is subject to relatively wide variation and a relatively constant pressure and flow rate output is desired.

Thus it is an object of the present invention to provide a variable displacement vane pump.

It is a further object of the present invention to provide a high efficiency variable displacement vane pump.

It is a still further object of the present invention to provide a variable displacement vane pump having a plurality of axially extending inserts in the rotor.

It is a still further object of the present invention to provide a variable displacement vane pump having a plurality of axially extending pockets in the rotor.

It is a still further object of the present invention to provide a variable displacement vane pump having a plurality of axially extending inserts which are attached to the rotor by springs.

It is a still further object of the present invention to provide a variable displacement vane pump exhibiting higher displacement at lower rotational speeds and lower displacement at higher rotational speeds.

Further objects, advantages and areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
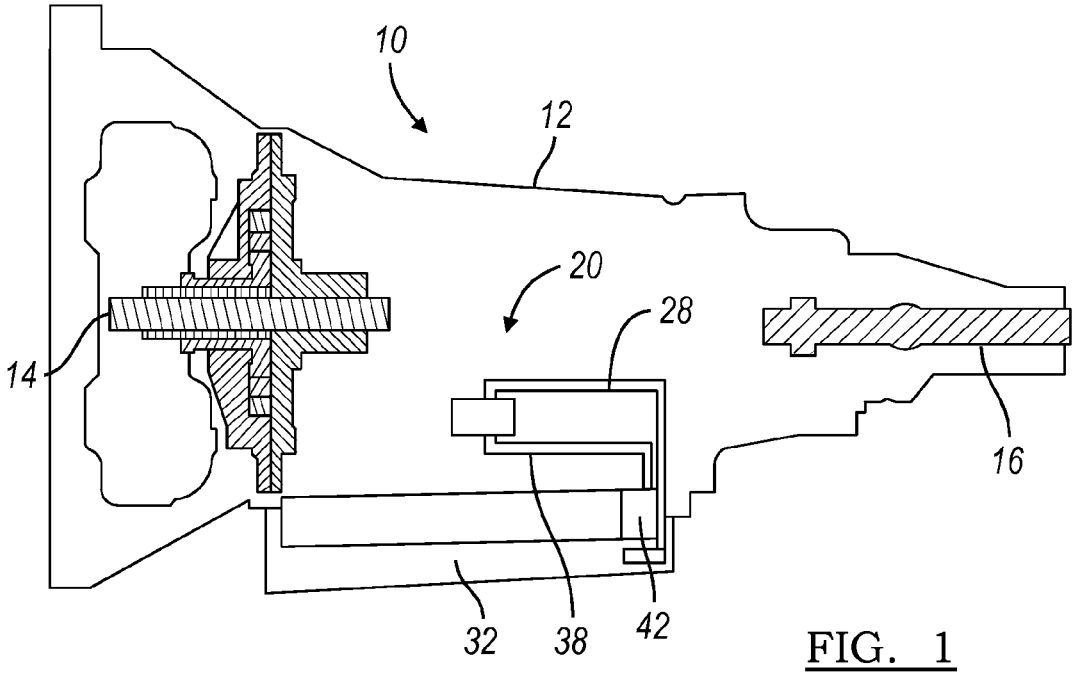
FIG. 1 is a side elevational view with portions broken away of an automatic transmission incorporating the present invention.
Figure 2:
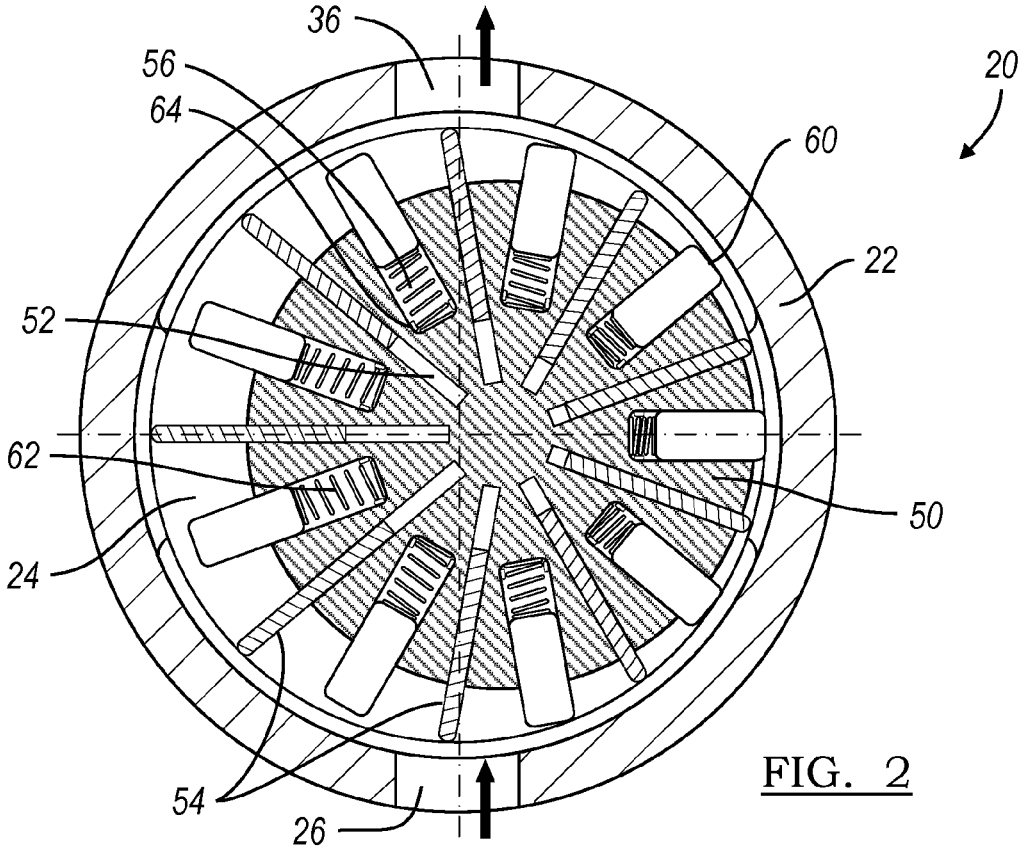
FIG. 2 is a full sectional view of a first embodiment of a variable displacement vane pump according to the present invention.

With reference now to FIGS. 1 and 2, an exemplary automatic transmission is illustrated and generally designated by the reference number 10. The automatic transmission 10 includes a housing 12 having various openings, surfaces, flanges and passageways that receive, locate and support the numerous components of the automatic transmission 10. Among these components are an input shaft 14 and an output shaft 16. Supplied with rotational energy from a component of the automatic transmission 10 is a variable displacement vane pump 20. As noted above, the automatic transmission 10 is but one application for a variable displacement vane pump 20 according to the present invention. It has broad application and utility in installations and devices requiring a relatively constant pressure and flow output notwithstanding a relatively widely varying input speed.

The variable displacement vane pump 20 includes a typically cylindrical pump housing 22 which defines an interior cylindrical cavity 24. The pump housing 22 defines an inlet port 26 which draws hydraulic fluid through a line or passageway 28 from a sump 32 in the lower portion of the transmission housing 12. The pump housing 22 also defines an outlet port 36 which supplies pressurized hydraulic fluid to a supply or feed line or passageway 38 and, optionally, a pressure regulator valve 42.

Disposed on an axis offset from the axis of the interior cylindrical cavity 24, in accordance with conventional practice, is a pump rotor 50. The pump rotor 50 is preferably cylindrical and includes a plurality of axially extending and radially oriented narrow slots 52 which freely slidably receive and retain a like plurality of vanes 54. The vanes 54 are maintained in close contact with the surface of the interior cylindrical cavity 24 by centrifugal force as the pump rotor 50 rotates.

Disposed between each adjacent pair of vanes 54, is a wider, axially extending and radially oriented slot or pocket 56. Each of the wider slots or pockets 56 slidably receives a displacement reducing member or insert 60. The members or inserts 60 are retained in the wider slots or pockets 56 by tension springs 62. Each of the members or inserts 60 is retained by at least two of the tension springs 62 although more, e.g., three or four, may be utilized if desired, to achieve improved radial stability. Additionally, although the radially inward limit of travel of the inserts or members 60 will typically be established by full compression of the tension springs 62, the radially inward and outward travel of the members or inserts 60 may be limited by stops 64 which may take the form of shoulders, pins, projections or other travel limiting features.

In operation, a variable displacement vane pump 20 according to the present invention exhibits maximum displacement and thus maximum flow per rotation of the rotor 50 at low speeds. In the condition of maximum displacement, the members or inserts 60 are fully retracted within the slots or pockets 56 of the rotor 50. As the speed of the rotor 50 increases due to an increase in the operating speed of components of the automatic transmission 10, the members or inserts 60 translate radially outwardly relative to the rotor 50 and occupy increasing volume in the space between each pair of adjacent vanes 54, thereby reducing the displacement of the vane pump 20 and the pumped volume per rotation of the vane pump 20.

Figure 3:
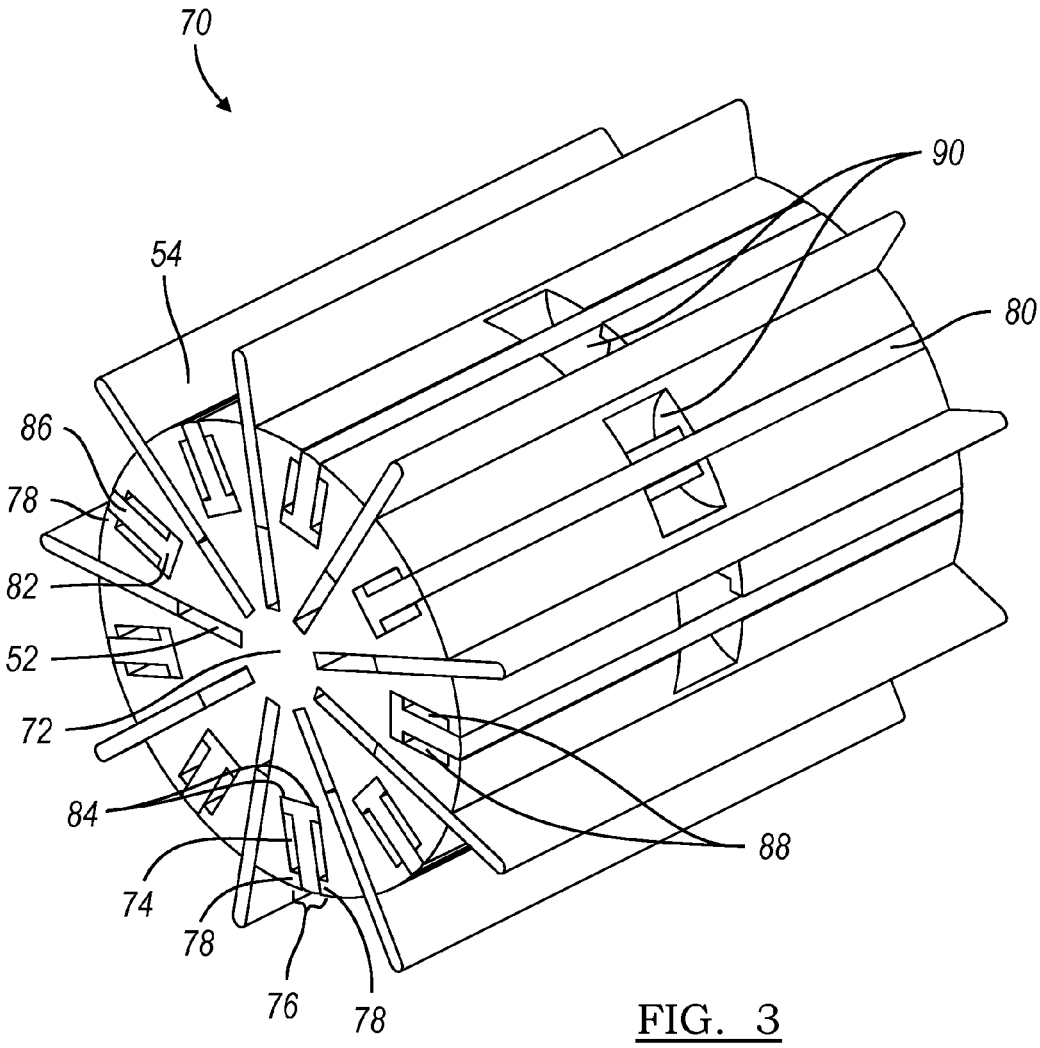
FIG. 3 is a fragmentary, perspective view of a rotor of another embodiment of a variable displacement vane pump according to the present invention.

Referring now to FIG. 3, a portion of another embodiment of a variable displacement vane pump according to the present invention is illustrated and designated by the reference number 70. The variable displacement vane pump 70 includes the cylindrical pump housing 22 which defines an interior cylindrical cavity 24, the inlet port 26 and the outlet port 36 all of which are illustrated in FIG. 2. The variable displacement vane pump 70 also includes a rotor 72 defining a plurality of axially extending and radially oriented slots 52 which each receive a vane 54. Alternating with the plurality of slots 52 are a like plurality of channels or grooves 74 having axially extending mouths 76 that are defined by a opposed, symmetrical pair of overhanging lips or shoulders 78. Disposed in each of the channels or grooves 74 are T-shaped members or inserts 80. The T-shaped inserts 80 have a wider portion 82 defining first and second shoulders or flanges 84 just slightly smaller than the width of the channels or grooves 74 disposed more proximate the center of the rotor 72 and a narrower portion 86 just slightly smaller than the width of the axially extending mouths 76. On both sides of the T-shaped inserts 80 are compression springs 88. The compression springs 88 may be coil springs in which case at least two will be used on each side of the T-shaped member 80 or more preferably be leaf springs or wave springs which extend axially along the shoulders or flanges 84.

Thus it will be appreciated that as the rotational speed of the rotor 72 increases, centrifugal force will act on the T-shaped members or inserts 80 and they will translate radially outwardly from their retracted positions in the rotor 72, reducing the displacement of the variable displacement vane pump 70. As the rotational speed of the rotor 72 decreases, the compression springs 88 will overcome centrifugal force and the T-shaped members or inserts 80 will retract.

It will also be appreciated that as the T-shaped members or inserts 80 extend and operate in the extended position for a period of time, hydraulic fluid will fill the channels or grooves 74 behind, i.e., radially inwardly from, the T-shaped members or inserts 80. As the rotor 72 slows, this accumulation of hydraulic fluid may slow retraction of the T-shaped members or inserts 80. To facilitate out flow of hydraulic fluid from the regions of the channels or grooves 74 behind the T-shaped members or inserts 80, one or more semi-circular, or other readily machined shape, channels or slots 90 are disposed across each of the channels or grooves 74 having a depth preferably equal to the depth of the channels or grooves 74. These channels or slots 90 facilitate flow of hydraulic fluid both into and out from the region behind the T-shaped members or inserts 80.

It will be appreciated that with both variable displacement vane pump embodiments 20 and 70, the precise speed to pumped flow relationship may be adjusted to suit particular flow requirements and flow to speed relationships. For example, it should be understood that higher spring rate tension springs 62 and compression springs 88 will shift the self-compensating nature of the present invention by requiring higher rotational speeds before displacement and flow reduction per rotation occur whereas lower spring rate tension springs 62 and compression springs 88 will cause the displacement and flow reduction per rotation to occur at lower rotational speeds.

It should also be understood that any preload of the tension springs 62 and the compression springs 88 will raise the threshold rotational speed of the rotors 50 and 72, respectively, at which the members or inserts 60 and 80 will commence movement and begin to reduce the displacement of the vane pumps 20 and 70. Accordingly, careful selection of the spring rate and the preload of the tension springs 62 and the compression springs 88 as well as the radial positions and the masses of the members or inserts 60 and 80 can result in vane pumps 20 and 70 that provide a flow and pressure output having good uniformity over a wide rotational speed range.

The description of the invention is merely exemplary in nature and variations that do not depart from the gist of the invention are intended to be, and are, within the scope of the invention. Such variations are not to be regarded as a departure from the spirit and scope of the invention.

What is claimed is:

1. A variable displacement vane pump comprising, in combination, a housing defining a cylindrical pumping cavity and defining an inlet port and an outlet port, and a rotor disposed in said cylindrical pumping cavity, said rotor defining a plurality of first axial slots and having a vane slidably received in each of said first slots, said rotor also defining a plurality of second axial slots and having a volume reducing member received in each of said second slots and means for controlling a radial position of said members relative to a rotational speed of said rotor, whereby a displacement of said vane pump reduces as said rotational speed of said rotor increases.

2. The variable displacement vane pump of claim 1 wherein said inlet port is in fluid communication with a sump.

3. The variable displacement vane pump of claim 1 wherein said rotor is a cylinder eccentrically disposed in and offset from a center of said cylindrical pumping cavity of said housing, and wherein an outer portion of said rotor opposes an inner surface of said cavity.

4. The variable displacement vane pump of claim 1 wherein said means for controlling are tension springs.

5. The variable displacement vane pump of claim 1 wherein said means for controlling are compression springs.

6. The variable displacement vane pump of claim 1 wherein said rotor defines a plurality of stops disposed at an outer radial portion of said second axial slots for limiting translation of said members.

7. The variable displacement vane pump of claim 1 wherein said first axial slots are narrower than said second axial slots, and wherein said first axial slots and said second axial slots extend axially and are oriented radially in the rotor.

8. A variable displacement vane pump comprising, in combination, a housing defining a pumping cavity having an inlet port and an outlet port, and a rotor disposed in and offset from a center of said pumping cavity, said rotor defining a first plurality of axially extending and radially oriented slots and a vane received in each of said first plurality of axial slots, said rotor also defining a second plurality of axially extending and radially oriented slots, an insert received in each of said second plurality of axial slots and means for varying a radial position of said inserts in response to a rotational speed of said rotor.

9. The variable displacement vane pump of claim 8 wherein said means for varying translates said inserts toward said rotor at lower rotational speeds and translates said inserts away from said rotor at higher rotational speeds.

10. The variable displacement vane pump of claim 8 wherein said inlet port is in fluid communication with a sump.

11. The variable displacement vane pump of claim 8 wherein said pumping cavity is cylindrical and said rotor is a cylinder eccentrically disposed in said pumping cavity.

12. The variable displacement vane pump of claim 8 wherein said first plurality of axial slots are narrower than said second plurality of axial slots.

13. The variable displacement vane pump of claim 8 wherein said means for varying are tension springs.

14. The variable displacement vane pump of claim 8 wherein said means for varying are compression springs.

15. The variable displacement vane pump of claim 8 further including stops in said second plurality of axial slots for limiting translation of said inserts.

16. A variable displacement vane pump comprising, in combination, a housing defining a cylindrical cavity, an inlet and an outlet, and a rotor disposed in said cylindrical cavity, said rotor defining a plurality of narrower axially extending and radially oriented slots and a vane received in each of said narrower axially extending and radially oriented slots, said rotor also defining a plurality of wider axially extending and radially oriented slots, an insert received in each of said wider axially extending and radially oriented slots and means for adjusting radial positions of said inserts in response to a rotational speed of said rotor.

17. The variable displacement vane pump of claim 16 wherein said radial positions of said inserts are retracted at slower speeds and extended at higher speeds.

18. The variable displacement vane pump of claim 16 wherein said means for adjusting are one of tension springs and compression springs.

19. The variable displacement vane pump of claim 16 wherein said cylindrical cavity of said housing defines an axis, and wherein said rotor is a cylinder eccentrically disposed in said cylindrical cavity and offset from said axis.

20. The variable displacement vane pump of claim 16 wherein said inlet is in fluid communication with a sump.

* * * * *